United States Patent [19]

Rogosich et al.

[11] Patent Number: 4,867,324

[45] Date of Patent: Sep. 19, 1989

[54] NURSING ATTACHMENT FOR DISPOSABLE BEVERAGE CONTAINERS

[76] Inventors: John Rogosich, 40-15 Utopia Pkwy., Flushing, N.Y. 11358; Mona Darwish, 2401 Pennsylvania Ave., (Apt. 9822), Philadelphia, Pa. 19130

[21] Appl. No.: 202,810

[22] Filed: Jun. 3, 1988

[51] Int. Cl.[4] ..... A61J 11/00; A61J 11/04

[52] U.S. Cl. ..... 215/11.1; 215/11.6

[58] Field of Search ..... 215/11.1–11.6; 222/91

[56] References Cited

U.S. PATENT DOCUMENTS

| | | | |
|---|---|---|---|
| 2,125,805 | 8/1938 | Peddicord | 222/91 |
| 2,438,299 | 3/1948 | Relis | 215/11.1 |
| 3,115,980 | 12/1963 | De Woskin | 215/11.1 |
| 3,146,904 | 9/1964 | Hansen et al. | 215/11.1 |
| 3,187,918 | 6/1965 | Moore | 215/11.6 |
| 3,194,424 | 7/1965 | Barr | 215/11 |
| 3,253,753 | 5/1966 | Barton et al. | 215/11.1 X |
| 3,266,910 | 8/1966 | Barnby | 99/171 |
| 3,273,703 | 9/1966 | Stribley | D24/47 |
| 3,278,083 | 10/1966 | Serafini | 222/91 |
| 3,519,157 | 7/1970 | Meierhoefer | 215/11.6 |
| 3,635,724 | 1/1972 | Schaar | 215/11.6 |
| 3,746,198 | 7/1973 | Howland | 215/11.1 |
| 3,768,698 | 10/1973 | Corty, Sr. et al. | 222/91 |
| 4,412,623 | 11/1983 | Schmidt | 215/11.1 |
| 4,637,934 | 1/1987 | White | 215/11.4 |
| 4,657,151 | 4/1987 | Cabernoch | 215/11.4 |

FOREIGN PATENT DOCUMENTS

| | | | |
|---|---|---|---|
| 675333 | 12/1963 | Canada | 222/91 |
| 679540 | 2/1964 | Canada | 222/91 |

*Primary Examiner*—Sue A. Weaver

[57] ABSTRACT

An improved feeding device for infants comprises a sharply pointed, tapered hollow stem of plastic or similar rigid material, to which a flexible nipple is attached at the broad, bored end. The shaft of the tapered stem has at its periphery an integrally molded fastening device, such as screw threads, expansion members or bayonet-type locking grooves. The stem's pointed end is used to perforate the wall of a prefilled, sealed container. Further insertion causes the fastening device to firmly attach the stem to the container wall, the nipple then being ready for use.

2 Claims, 3 Drawing Sheets

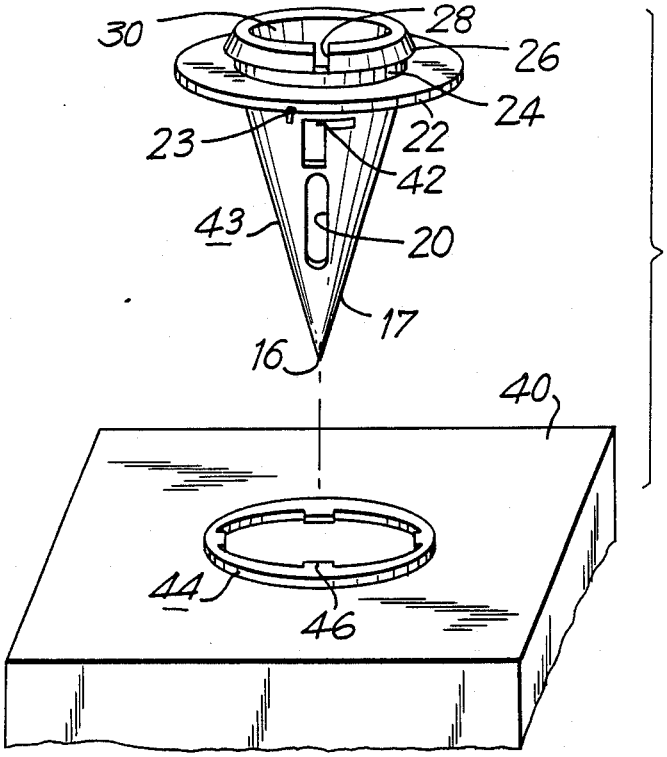
FIG. 3
FIG. 4
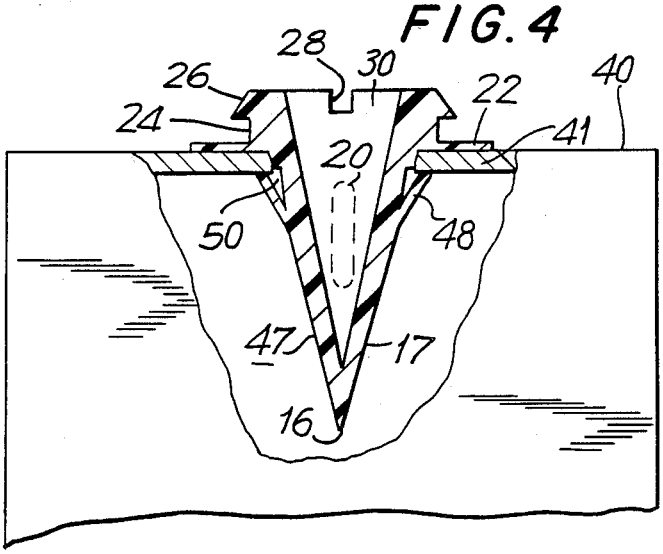

NURSING ATTACHMENT FOR DISPOSABLE BEVERAGE CONTAINERS

BACKGROUND—FIELD OF THE INVENTION

The present invention relates, in general, to nursing devices for feeding liquid to an infant. More particularly, the present invention relates to a nippled feeding appliance which may be attached to many commercially available, prefilled, disposable paper, metallic, or plastic liquid containers, converting said containers into disposable infant nursing bottles of utmost conveniences and cleanliness.

BACKGROUND—DESCRIPTION OF PRIOR ART

Many attempts have been made to improve upon the standard nursing bottle, which consists of a bulky and fragile glass or plastic bottle, closed at one end by a nipple and threaded ring. In use, the nurser must be filled with a measured amount of liquid and sealed with the nipple and threaded ring. Following use, the bottle must be disassembled and thoroughly sterilized to ensure the health of the infant. Further, the standard reusable nursing bottle suffers from a hitherto little-known danger: to maintain the conflicting properties of flexibility and durability of the nipple, certain chemical additives must be used in the plastic compound of which it is composed. These additives have been shown to be carcinogenic, forcing many manufacturers to warn the consumer to boil the nipple before use in order to remove those additives nearest the surface. Virtually all improvements upon the standard nursing bottle and nipple have been improvements in form, as opposed to improvements in function.

In institutions such as hospitals and clinics, where large numbers of infants must be fed on a regular basis, attempts have been made to streamline the feeding process by eliminating the aforementioned need for measuring and sterilizing. A small, prefilled standard bottle, closed at one end with a removeable hermetic seal, is often packaged along with an appropriate nipple and threaded ring. In use, the nipple assembly and bottle are removed from the aseptically sealed package. The hermetic seal is removed from the bottle, the nipple attached, and the infant fed. Upon completion of the feeding, the bottle is disposed of. Although an effective labor saving method, this type of packaged bottle and nipple is prohibitively expensive and cumbersome for domestic use, its use being limited to institutional settings. Further, such a nurser requires extensive handling in its preparation, which may compromise the sterility of the package and its contents.

An economical disposable infant nurser would prove highly desirable to both institutions and individual consumers. Several attempts of varying effectiveness have been made to meet this urgent need by altering the design of the nipple and/or package, all such attempts failing to meet the dual requirements of minimal handling and use of industry-standard packaging materials and techniques.

The nipple assembly in U.S. Pat. No. 2,438,289 to Relis, Mar. 23, 1948 is a cap-like device installed on the neck of a prefilled, sealed can. The nipple assembly includes a can opening blade on its underside.

The nipple and container assembly in U.S. Pat. No. 3,115,980 to De Woskin, Dec. 31, 1063 is a cap-like device installed on the top of a can which the user has previously perforated.

The nipple and container assembly in U.S. Pat. No. 3,187,918 to Moore, June 8, 1965 is a cap-like device installed on the top of a specially designed can. The nipple assembly has various perforating devices mounted on its underside.

The nipple assembly in U.S. Pat. No. 3,266,910 to Barnby, Aug. 16, 1966 requires a non-standard bottle. The nipple assembly in U.S. Pat. No. 3,253,753 to Barton et al, May 31, 1966 is a plug-like device or connector which is inserted into a specially shaped perforation in the top of a metal, prefilled can. The perforation is made by the user with a separate, specially designed punch.

The nipple assembly in U.S. Pat. No. 3,273,703 to Stribley, Sept. 20, 1966 requires a non-standard bottle.

The nipple assembly in U.S. Pat. No. 3,519,157 to Meierhoefer, July 7, 1970 requires both extensive, time-consuming piercing of the package (which may compromise its sterility through excessive handling) and a nonstandard bottle.

Similarly, U.S. Pat. No. 4,412,623 to Schmidt, Nov. 1, 1983 required both excessive handling and a non-standard bottle.

Mere redesign of the nipple assembly proving deficient, attempts have heretofore been made to provide a prefilled, disposable, completely integrated bottle/nipple assembly. All will be found to suffer from one or more of the following: bulkiness, fragility, need for excessive handling, non-standard packaging, insufficient anti-tampering protection, expensive manufacturing requirements and, therefore, higher retail cost. The disposable nurser in U.S. Pat. No. 3,146,904 to Hansen et al, Sept. 1, 1964 is a specially designed prefilled and sealed plastic bottle, to the neck of which must be attached a mating cap-like nipple. The bottle's seal is ruptured by means of a sharpened plunger-like device located on the underside of the nipple.

The disposable nurser in U.S. Pat. No. 3,194,424 to Barr, July 13, 1965 requires excessive mechanical manipulation in order to create a passageway for the liquid.

The disposable nursers in U.S. Pat. No. 3,635,724 to Schaar, Jan. 18, 1971 use fragile levered assemblies to unseal the bottle. Such assemblies may inadvertently unseal the package at any time during transit, unbeknownst to the consumer.

The disposable nurser in U.S. Pat. No. 3,746,198 to Howland, July 17, 1973 requires the sealed bottle/nipple assembly to be disassembled, the bottle's hermetic seal broken, and the nipple reinstalled. Such excessive handling is both inconvenient and unsanitary.

The disposable nurser in U.S. Pat. No. 4,637,934 to White, Jan. 20, 1987 has a spiked plunger assembly mounted internally. Any compression of the bottle during transit will result in the rupturing of the internal sanitary seal, with no such indication being apparent to the consumer. Further, the bottle is of such design as to be difficult to hold and store.

The disposable nurser in U.S. Pat. No. 4,657,151 to Cabernoch, Apr. 14, 1987 shows an expensive double-walled construction method requiring elaborate manufacturing facilities. The bottle is of such design as to be impossible to store conveniently.

It is thus apparent that as disposable nipples have required inconvenient handling and specially designed bottles for proper use, disposable, completely integrated nursing systems have relied on expensive package designs or elaborate, potentially dangerous mechanical devices for their function.

Consumers would find most desirable a nursing system which is at once disposable, inexpensive, convenient, easily stored and which makes product-tampering readily apparent, qualities which have not heretofore been combined in a single product. These qualities may be realized by supplying such a device as would convert certain standard, prefilled beverage containers, which are readily available to the consumer, into an infant nurser.

OBJECTS AND ADVANTAGES

Accordingly we claim the following as our objects and advantages of the invention: to provide to the consumer a device which quickly, neatly and inexpensively converts standard, prefilled, readily available beverage containers into safe, clean and disposable infant nursers, to provide to manufacturers a method whereby their infant formulas, juices and milk may be packaged in economical, biodegradable containers requiring little further handling by the consumer for use in infant feeding, and to provide a nursing device whose design incorporates various features conducive to the safety of the infant.

In addition we claim the following objects and advantages: to provide a nursing device which may be discarded along with the packaging or, if constructed of sufficiently durable materials, cleansed and reused by the consumer, and to provide a nursing device which can be manufactured of materials entirely safe to the infant.

Readers will find further objects and advantages of the invention from a consideration of the ensuring description and the accompanying drawings.

DRAWING FIGURES

FIG. 3 shows a bayonet-type locking device, according to another embodiment of the stem.

FIG. 4 shows a cross-sectional view of an expansion-type locking device, according to another embodiment of the stem.

DRAWING REFERENCE NUMERALS

Figure 1:
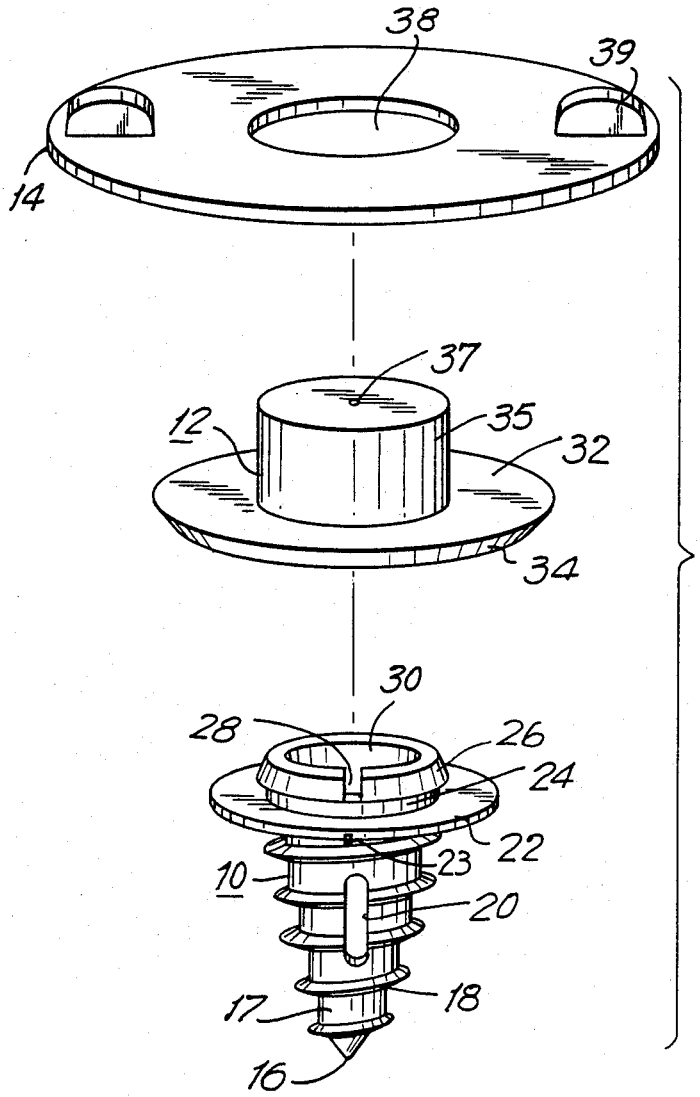
FIG. 1 shows an exploded perspective view of the nursing attachment in its preferred embodiment.

10 stem
12 nipple
14 annular retaining ring
16 piercing tip
17 stem shaft
18 stem screw threads
20 outlet
22 annular limiting flange
23 air inlet groove
24 elliptical waist
26 elliptical locking ridge
28 relief cutout
30 bore
32 annular mounting seat
34 integral skirt gasket
35 nipple shaft
36 nipple chamber
37 nipple hole
38 elliptical hole
39 finger grip
40 container
41 container wall
42 locking groove
43 locking grooved stem
44 reinforcing disk
46 locking tab
47 expansion membered stem
48 expansion member
50 expansion member pocket
51 membranous wrapper

PREFERRED EMBODIMENT OF NURSING ATTACHMENT—DESCRIPTION

FIG. 1 shows an exploded perspective view of the preferred embodiment of the invention. The nursing attachment comprises a single-piece stem 10 of rigid plastic or similar material, a single-piece nipple 12 of flexible rubber or similar material, and a single-piece annular retaining ring 14 of rigid plastic or similar material.

Stem 10 comprises a hollow, tapered stem shaft 17 terminating at its closed end with piercing tip 16. Encircling stem shaft 17 and extending its full longitudinal length are stem screw threads 18. Stem shaft 17 and stem screw threads 18 both are pierced by outlet 20, whose length is parallel to the longitudinal axis of stem 10, and whose depth extends radially to the center of stem 10 to meet bore 30, thus forming a continuous fluid passageway. Stem shaft 17 terminates at annular limiting flange 22, which constrains nipple 12 upon assembly. Air inlet groove 23 is a shallow depression extending radially along the underside of annular limiting flange 22 and longitudinally a short distance along stem shaft 17, forming a channel to admit air to replace displaced liquid. Annular limiting flange 22 is surmounted by elliptical waist 24, which terminates with elliptical locking ridge 26, a protuberance which captures nipple 12 and annular retaining ring 14 upon assembly. Relief cutout 28 permits elliptical locking ridge 26 such flexibility as to clear annular retaining ring 14 upon assembly.

Nipple 12 comprises an annular mounting seat 32 which is molded at its periphery into an integral shirt gasket 34, which is concentric with, and tapers toward, the longitudinal axis. Annular mounting seat 32 is surmounted by nipple shaft 35, which has a generally elliptical cross-section. Nipple shaft 35 is pierced at its top by nipple hole 37, which extends into nipple chamber 36, thus forming a continuous liquid passageway through the longitudinal axis of nipple 12. Integral skirt gasket 34, nipple chamber 36 and nipple hole 37 are best shown in the cross-sectional view FIG. 2.

Annular retaining ring 14 comprises a thin, disk-shaped member pierced centrally by elliptical hole 38, which is of such dimension as to mate with elliptical waist 24 with small clearance. Annular retaining ring 14 has on its top-most surface two occurrences of finger grip 39.

PREFERRED EMBODIMENT OF NURSING ATTACHMENT—OPERATION

Figure 2:
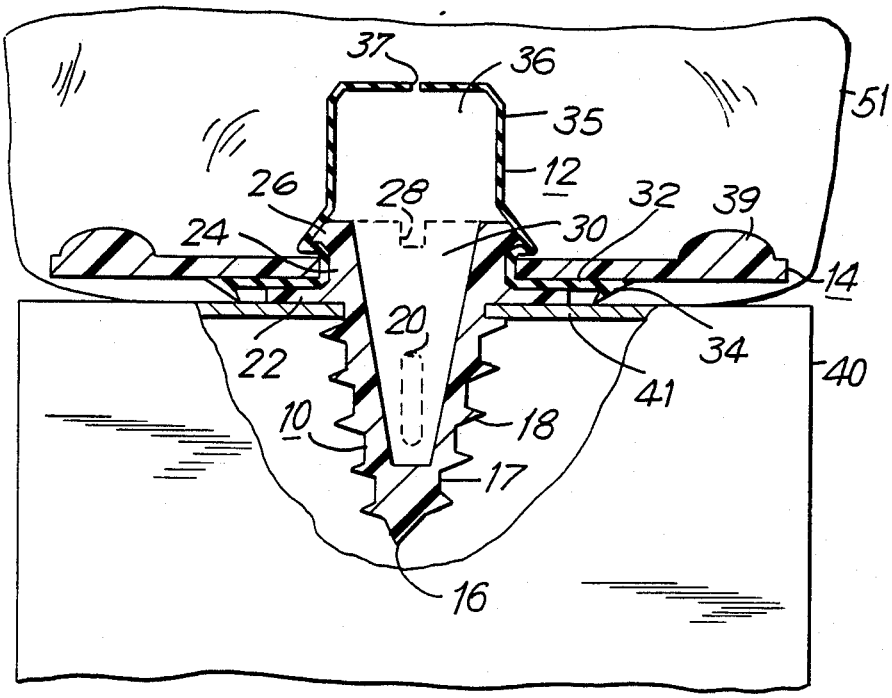
FIG. 2 shows a cross-sectional view of the preferred embodiment of the nursing attachment in its installed position, and illustrating such features as are not apparent in the exploded view.

To fully explain the use of the present invention, reference will be made to FIG. 1 and FIG. 2.

Prior to use by the consumer, the manufacturer will have assembled and packaged the invention under sterile conditions. Assembly consists of placing annular mounting seat 32 of nipple 12 over the elliptical locking ridge 26 of stem 10. Nipple 12 is then pushed longitudinally along stem 10 until the underside of annular mounting seat 32 is flush against annular limiting flange 22. Annular retaining ring 14 completes the assembly as elliptical hole 38 is oriented concentric with nipple shaft 35 and elliptical locking ridge 26, and is then pushed longitudinally along nipple shaft 35. Annular retaining ring 14 will exert pressure upon the circumference of elliptical locking ridge 26, which is permitted to flex by means of relief cutout 28. Once pushed past elliptical locking ridge 26, annular ring 14 will come to rest flush against the uppermost side of annular mounting seat 32 and in the transverse plane of elliptical waist 24. Elliptical locking ridge 26 returns to its original shape, thereby capturing annular retaining ring 14, which in turn holds together the assembly of nipple 12 and stem 10 by mechanical pressure. By use of such mating elliptical cross sections, rotations of annular retaining ring 14 during use by the consumer is prevented. Further, such curved mating surfaces prevent tearing of the thin wall of nipple 12, as would occur through use of other rotation-limiting arrangements.

The completed assembly, having been thoroughly sterilized, may be packaged in a suitable membranous wrapper 51 of paper or plastic.

To use as a nursing device, the package assembly is grasped by each finger grip 39. Piercing tip 16 is brought close to container wall 41, at which time the assembly is gently but firmly forced to penetrate both its membranous wrapper 51 and container wall 41. As piercing tip 16 penetrates container wall 41 more deeply, stem screw threads 18 may engage container wall 41 by turning the assembly in a clockwise motion until firmly attached. FIG. 2 shows a cross-sectional view of the invention in place. The membranous wrapper 51 may then be stripped away, exposing nipple hole 37 for use. As the infant sucks, liquid is drawn through outlet 20, bore 30, nipple chamber 36 and nipple hole 37, which now form a continuous passageway, while air is drawn through integral skirt gasket 34 and air inlet groove 23 into container 40 to replace the displaced liquid. Integral skirt gasket 34, compressed against container wall 41, is so shaped as to permit air to enter, while preventing stray liquid from escaping. When feeding is completed, the nursing attachment and liquid container may be conveniently disposed of.

SECOND EMBODIMENT OF THE INVENTION—DESCRIPTION

FIG. 3 shows a second embodiment of the invention, with stem 10 replaced by locking grooved stem 43. It will prove more convenient to use, but more costly to manufacture, than the preferred embodiment. Stem screw threads 18 are replaced by two or more occurrences of locking groove 42, which is comprised of two perpendicular depressions, one of which is parallel to, and the other transverse to, the longitudinal axis of stem shaft 17, and which meet at a common juncture. FIG. 3 shows reinforcing disk 44, which the manufacturer will have installed upon container 40. Reinforcing disk 44 comprises an annular disk of rigid plastic or similar material with two or more occurrences of locking tab 46, each of which is so shaped and arranged as to mate with its respective locking groove 42.

SECOND EMBODIMENT OF STEM—OPERATION

Assembly and packaging may proceed as detailed in the preferred embodiment. In use, piercing tip 16 is placed in the center of reinforcing disk 44, through the center of which container wall 41 is visible. The locking grooved stem 43 is similarly forced to penetrate its membranous wrapper 51 and container wall 41, until such point as each locking tab 46 enters its respective locking groove 42. The assembly is firmly twisted in a short, clockwise direction to lock firmly into place. Use may then proceed as in the preferred embodiment.

THIRD EMBODIMENT OF STEM—DESCRIPTION

FIG. 4 shows a cross-section of a third embodiment of the invention in its installed position, with stem 10 replaced by expansion membered stem 47. Its use will be more convenient than the preferred embodiment, being more rapidly installed by the consumer. However, it will not prove as sturdy as the preferred embodiment. Stem screw threads 18 are replaced by two or more occurrences of expansion member 48. Expansion member 48 comprises a generally rectangular, molded appendage of stem shaft 17, having its axis parallel to the longitudinal axis of stem 10. The lower portion of expansion member 48 is molded in such manner as to provide a smooth transition between itself and stem shaft 17. Further, expansion member 48 has its uppermost portion unrestrained, thereby forming an acute angle with the periphery of stem shaft 17. Expansion member pocket 50 is a shallow groove of such size and orientation as to permit relief for expansion member 48.

THIRD EMBODIMENT OF STEM—OPERATION

Assembly and packaging may proceed as detailed in the preferred embodiment. In use, piercing tip 16 is placed in proximity to container wall 41. The expansion membered stem 47 is similarly forced to penetrate its membranous wrapper 51 and container wall 41, until such point as container wall 41 exerts pressure upon each expansion member 48. Increased lateral pressure forces the free end of each expansion member 48 to enter its expansion member pocket 50. The assembly is firmly pushed through container wall 41 until each expansion member 48 springs back to its original shape, locking the assembly into place as shown in FIG. 4. Use may then proceed as in the preferred embodiment.

CONCLUSION, RAMIFICATIONS AND SCOPE OF INVENTION

Thus the reader will see that the nursing attachment of the invention provides many advantages over the prior art. The present invention can be manufactured easily and inexpensively. It is quickly assembled for use. It can be entirely disposable, providing unrivalled convenience and cleanliness for the consumer. Durability not being a factor, it can be manufactured from lightweight materials which are entirely safe and non-toxic. In the unlikely event the device became detached from the container, the annular retaining ring would be of sufficient diameter to prevent ingestion by the infant. Unlike the prior art, it uses a standard beverage packaging system which is already widely available and inexpensive.

While the above lengthy description provides many details of construction and use, these should not be construed as limitations on the scope of the invention, but rather as exemplifications of the preferred embodiment and several of its variations thereof. Many other variations are possible. For example, the manufacturer may assemble the invention using such fastening methodologies as adhesives, rivets, screws and screw threads, and heat shrinking materials. The invention could be molded under heat in several stages, making the described assembly unnecessary. The nipple could be attached directly to the stem, without use of the annular retaining ring; however, the nipple would have to be constructed of heavy material to develop sufficient holding strength. Further, the integral skirt gasket could be eliminated, requiring use of a separately attached gasket at the stem/container wall interface; the simplicity and economy of material of the preferred embodiment would be lost. various methods of securing the invention to the container may be employed, including harnesses, useractuated rivets, etc., none of which will be found as convenient and inexpensive as those methods previously detailed. The beverage manufacturer could further ease securing of the invention by preperforating the container, resealing the package with a thin metallic or plastic film; this would be necessary if a metallic container were used, since penetration of such material would otherwise prove difficult.

Accordingly, the scope of the invention should be determined not by the embodiments illustrated, but by the appended claims and their legal equivalents.

We claim:

1. A nursing device for converting a commercial beverage container into a disposable nursing container comprising in combination:

a puncturing means comprising a hollow stem having a closed end forming a piercing tip, an opening in the side of said stem and fastening means securing said stem to the wall of the container;

a hollow nipple in communication with said opening and including a flanged portion having a gasket means on the lower surface thereof;

and an annular retaining ring in the form of a planar disc for securing the nipple to said hollow stem;

said hollow stem terminating in an open end on the exterior of the container and including an annular recess for receiving and retaining both said nipple and said retaining ring.

2. The nursing device of claim 1 wherein said gasket means is formed on the periphery of said nipple flanged portion to provide an inwardly tapering, downwardly directed integral projection whereby such liquid as may leak from said container is captured.

* * * * *